US005256322A

United States Patent [19]

Cohu

[11] Patent Number: 5,256,322

[45] Date of Patent: Oct. 26, 1993

[54] LUBRICATING OIL FOR METHANOL FUELED ENGINES

[75] Inventor: Linda K. Cohu, Rancho Palos Verdes, Calif.

[73] Assignee: Atlantic Richfield Company, Los Angeles, Calif.

[21] Appl. No.: 315,756

[22] Filed: Feb. 27, 1989

[51] Int. Cl.[5] ..... C10M 135/10

[52] U.S. Cl. ..... 252/33.2; 252/33; 252/40

[58] Field of Search ..... 252/40, 33, 33.2

[56] References Cited

U.S. PATENT DOCUMENTS

| | | | |
|---|---|---|---|
| 3,480,548 | 11/1969 | Hellmuth | 252/33 |
| 3,489,682 | 1/1970 | Lesuer | 252/33 |
| 4,283,294 | 8/1981 | Clarke | 252/33 |
| 4,797,217 | 1/1989 | Cleuerles | 252/41 |

FOREIGN PATENT DOCUMENTS

| | | | |
|---|---|---|---|
| 626842 | 9/1961 | Canada | 252/41 |
| 626843 | 9/1961 | Canada | 252/41 |

*Primary Examiner*—Ellen McAvoy
*Attorney, Agent, or Firm*—F. Lindsey Scott

[57] ABSTRACT

A lubricating oil for use in methanol fueled internal combustion engines, the lubricating oil having a total base number from 9.0 to about 14.0 and comprising:

a) a suitable base oil;

b) overbased sodium sulfonate in an amount sufficient to provide a base number from about 1.0 to about 2.0 in said lubricating oil; and c) at least one metal sulfonate selected from the group consisting of overbased calcium sulfonate, overbased magnesium sulfonate and mixtures thereof in an amount sufficient to provide a base number from about 8.0 to about 12.0 in said lubricating oil.

20 Claims, 1 Drawing Sheet

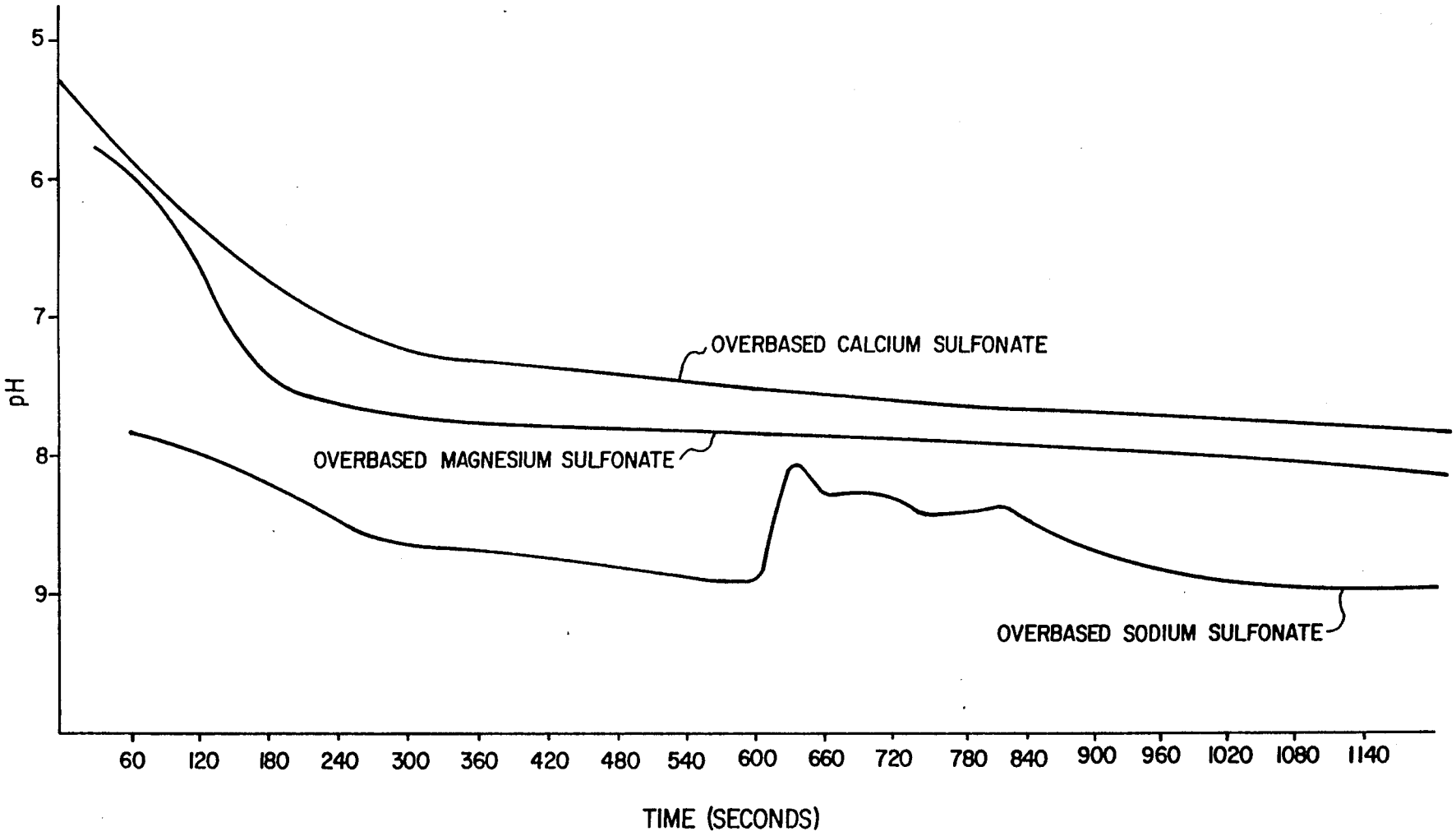
OVERBASED CALCIUM SULFONATE
OVERBASED MAGNESIUM SULFONATE
OVERBASED SODIUM SULFONATE
pH
5
6
7
8
9
TIME (SECONDS)
60
120
180
240
300
360
420
480
540
600
660
720
780
840
900
960
1020
1080
1140

LUBRICATING OIL FOR METHANOL FUELED ENGINES

This invention relates to lubricating oils particularly adapted to use in methanol fueled internal combustion engines.

In recent years, increasing efforts have been directed toward the use of methanol as a fuel for internal combustion engines. While methanol can be used as a fuel for such engines, the use of methanol requires that certain modifications be made to the engine and the engine lubricants. Such modifications to the engine relate to adjustments in the compression ratio, air-to-fuel ratio, and the like and are known to those skilled in the art.

In the development of methanol fueled engines, lubricating oils used for gasoline fueled engines have been used as crank case lubricants for the methanol fueled engines. Such lubricating oils have been partially effective, but do not offer adequate long term lubrication ability for methanol fueled engines. More particularly, such lubricants do not tolerate the substantial quantities of methanol and its combustion by-products, such as water, which eventually accumulate in the lubricating oil in a methanol fueled engine. Lubricating oils designed for gasoline engines do not effectively disperse the larger amounts of water or neutralize carboxylic acids such as formic acid and higher carboxylic acids which are produced upon combustion of methanol in internal combustion engines. The aqueous solutions of such carboxylic acids when circulated within the engine with the lubricating oil during operation of the engine tend to be very corrosive and result in deterioration of the engine. Existing lubricating oils have not been effective to neutralize such carboxylic acids.

As known to those skilled in the art, most gasoline engine lubricating oils contain an overbased additive such as an overbased metal sulfonate. Some overbased metal sulfonates commonly used are calcium and magnesium overbased sulfonates. Overbased sodium sulfonate has also been used in a limited number of oil formulations but overbased sodium sulfonate has been found to result in the formation of gels in lubricating oils and, as a result, has been considered unsuitable for use in most gasoline engine lubricating oils.

Accordingly a continuing effort has been directed to the development of improved lubricating oils for use in methanol fueled internal combustion engines.

According to the present invention, an improved lubricating oil for use in methanol fueled internal combustion engines is provided. The improved lubricating oil has a total base number from about 9 to about 14 and comprises a suitable base oil containing overbased sodium sulfonate in an amount sufficient to provide a base number from about 1.0 to about 2.0 in the lubricating oil and at least one overbased metal sulfonate selected from the group consisting of overbased calcium and magnesium sulfonates and mixtures thereof in an amount sufficient to provide a total base number from about 8.0 to about 12.0 in the lubricating oil while maintaining an ash (sulfated) content in the oil of less than about 1.4 weight percent. The Figure is a graph of the test results from Example 1.

It has been found that the use of mixtures of overbased sodium sulfonate and at least on other overbased metal sulfonate selected from the group consisting of overbased calcium sulfonate, overbased magnesium sulfonate and mixtures thereof is surprisingly effective in neutralizing carboxylic acids in lubricating oil used in methanol fueled engines. It has been found that the total base number in the lubricating oil should be from about 9.0 to about 14.0 and preferably from about 10.0 to about 13.0. A base number from about 1.0 to about 2.0 and preferably from about 1.4 to about 1.8 is provided in the lubricating oil by the over-based sodium sulfonate and a base number from about 8.0 to about 12.0 and preferably from about 9.0 to about 11.0 is provided in the lubricating oil by the other overbased metal sulfonate to provide a total base number in the lubricating oil from about 9.0 to about 14.0 and preferably from about 10.0 to about 13.0. While overbased barium sulfonate is effective as an overbased metal sulfonate, overbased calcium and magnesium sulfonates are preferred because of the higher ash content in the oil as a result of the use of overbased barium sulfonate. Typical ash levels permitted in lubricating oil are up to about 1.4 weight percent for gasoline engine lubricating oils and up to about 1.0 weight percent for diesel engine lubricating oils. These levels are more easily achieved with the lower ash overbased calcium and magnesium sulfonates, particularly the overbased magnesium sulfonates.

The ash levels are stated as the weight percent metal in the oil as a metal sulfate and the base numbers referred to are determined by ASTM D2896.

When overbased sodium sulfonate alone is used, it has been found that the lubricating oil is less effective in neutralizing the formic acid contained in the lubricating oil or water dispersed in the lubricating oil because of the gellation of the oil. Even when higher total base numbers are used in the lubricating oil with overbased sodium sulfonate alone being the source of the total base number, the lubricating oil has been found to be less effective in removing or neutralizing the acidic components because of the gellation of the oil.

It has also been found that the other overbased metal sulfonates when used alone in the lubricating oil are not as effective as the overbased sodium sulfonate to neutralize carboxylic acid in lubricating oils used in methanol fueled engines. Further, when total base numbers supplied as overbased calcium or magnesium sulfonate higher than about 15.0 are used, excessive ash levels are encountered in the oil and the oil tends to form unacceptable deposits which can be abrasive.

It has now been found that lubricating oils containing a combination of overbased sodium sulfonate with at least one overbased metal sulfonate selected from the group consisting of overbased calcium sulfonate and overbased magnesium sulfonate and mixtures thereof are surprisingly effective to neutralize carboxylic acids resulting from the combustion of methanol in internal combustion engines and in lubrication of such engines. The total base number in the lubricating oil for effective neutralization is desirably from about 9.0 to about 14.0. Desirably from about 7.0 to about 22.0 percent of the total base number is provided by the overbased sodium sulfonate.

Other additives such as detergent and corrosion inhibitor packages, viscosity improver additives, phosphate additives, and the like are typically used in commercially available lubricating oils for gasoline fueled engines and will normally be used in lubricating oils for methanol fueled engines along with the overbased sodium sulfonate and the overbased metal sulfonate. Such additives are considered to be known to the art and form no part of the present invention. The base lubricating oil used may be any suitable blend as known to those skilled in the art for the preparation of lubricating oil of the desired consistency. For instance, the formulation of a base oil or blend of oils to produce a 10 W 30 motor oil is well known to those skilled in the art. Similarly, the lubricating oil is desirably blended to meet standard ash and metal specifications as well as other lubricating oil specifications known to those skilled in the art The blending of lubricating oils to meet such specifications is considered to be well known to those skilled in the art and need not be discussed in detail. One lubricating oil blend according to the present invention for a 10 W 30 motor oil is:

| Component | Vol % | Wt % |
|---|---|---|
| 100 Neutral Oil | 49 | 48.80 |
| 250 Neutral Oil | 32 | 32.53 |
| SAE/SF Quality Detergent | 8.1 | 9.0 |
| Inhibitor Package | | |
| Secondary Zinc Dithiophosphate | | 0.54 |
| 400 TBN Sodium Sulfonate | | 0.42 |
| Olefin Copolymer Viscosity Index Improver | 7.2 | 7.06 |
| Sulfurized Fatty Acid (Friction Modifier) | | 1.00 |
| 400 TBN Magnesium Sulfonate | | 0.65 |

This oil has a total base number of 10.4 and a sulfated ash content of 1.3 weight percent.

The sulfonate precursors of the overbased sodium sulfonate and the other overbased metal sulfonates can be neutralized and overbased by procedures known to the art for the production of the overbased sulfonates. Such overbased metal sulfonates are commercially available in concentrate form for use in blending with lubricating oils.

Having discussed the invention by reference to its preferred embodiments, it is respectfully pointed out that the embodiments discussed are illustrative rather than limiting and that many variations and modifications are possible within the scope of the present invention. Many such variations and modifications may be considered obvious and desirable by those skilled in the art based upon a review of the foregoing description of preferred embodiments and the following examples.

EXAMPLE 1

Acid Neutralization Test Results

To investigate the effectiveness of various over-based sulfonates in neutralizing formic acid in lubricating oils used with methanol fueled engines which contain methanol and dispersed water a test procedure utilizing a two-phase system was used. An aqueous phase consisting of 200 ml of water containing 0.012 g of formic acid, 5 ml of a 50/50 (volume ratio) mixture of methanol and gasoline grade tertiary butyl alcohol and 20 ml of a solution of 0.045 molar sodium formate was prepared and mixing was started. After attaining a constant stirring rate, an initial pH reading of the aqueous phase was taken using a combination electrode. Twenty grams of a lubricating oil consisting of a blend of base oil, a viscosity improver, zinc dithiophosphate, a dispersant and an anti-oxidant was used for each test with the different overbased sulfonates shown in FIG. 1 to provide a total base number of 7 in each lubricating oil. The oil plus the overbased sulfonate was added to the aqueous phase with continued agitation. pH readings were taken at 30 second intervals and plotted as a function of time and pH as shown in the Figure.

Between about 600 and about 660 seconds the oil containing the overbased sodium sulfonate gelled and thereafter was less effective in neutralizing the aqueous phase. In all cases the overbased sodium sulfonate was more effective than the other overbased metal sulfonates tested.

EXAMPLE 2

Engine Tests

The oil blends prepared for Example 1 were tested in a CLR (Coordinating Lubricant Research) engine to determine their effectiveness as lubricants. Tests of this general type are discussed in detail in SAE paper 800857, "Effects of Alcohol Fuels on Engine Wear", E. C. Owens, H. W. Marbach, Jr.., E. A. Frame and T. W. Ryun, III, Jun. 9, 1980. The engine was fueled with methanol for all tests. The tests were conducted at 1550 rpm, a load of 1.9 (KW), an oil temperature of 57° C.±5° C. and a coolant temperature of 46° C. For all tests the engine was charged with the test oil and run for one hour at the test conditions, after which the oil was drained and the engine re-charged with fresh test oil for the test. All tests were run for 48 hours and the effectiveness of the oil was determined by measuring the wear (weight loss) on the third piston ring at the conclusion of each engine test.

In addition to the oils prepared in Example 1, two additional oils were tested. These oils were the same as the oils prepared for Example 1 except that the overbased sulfonates used were overbased magnesium sulfonate in an amount equal to a total base number of 10.0 in the oil (test 5) and a mixture of overbased sodium sulfonate and overbased magnesium sulfonate to provide a total base number in the oil of 10.4 of which 8.8 units of the total base number is supplied by the overbased magnesium sulfonate with 1.6 base number being supplied by the overbased sodium sulfonate (test 6). The results of the engine tests are shown below in Table 1.

TABLE 1

| Test # | Additive | Third Piston Ring Weight Loss (g) |
|---|---|---|
| 1 | overbased sodium sulfonate (7TBN) | 0.3238 |
| 2 | overbased magnesium sulfonate (7TBN) | 0.6443 |
| 3 | overbased barium sulfonate (7TBN) | 0.3811 |
| 4 | overbased calcium sulfonate (7TBN) | 0.6152 |
| 5 | overbased magnesium sulfonate (10TBN) | 0.3669 |
| 6 | overbased magnesium sulfonate (8.8) plus overbased sodium sulfonate (1.6) (10.4TBN) | 0.0275 |

As shown in Table 1 a surprisingly effective lubricating oil results from the use of overbased sodium sulfonate in combination with another overbased metal sulfonate (test 6). The synergistic reduction in wear as a result of the combination is not suggested by the effectiveness of either the overbased sodium sulfonate (test 1) or the overbased magnesium sulfonate (tests 2 and 5) alone.

Desirably the amount of overbased sodium sulfonate used is within the limits previously discussed to minimize the gelling tendencies of the oil as a result of the presence of the overbased sodium sulfonate while including sufficient overbased sodium sulfonate to produce the synergistic improvement.

Having thus described the invention I claim:

1. A lubricating oil for use in methanol fueled internal combustion engines, said lubricating oil having a total base number from about 9.0 to about 14.0 and consisting essentially of:

a) a suitable base oil;

b) overbased sodium sulfonate in an amount sufficient to provide a base number from about 1.0 to about 2.0 in said lubricating oil; and c) at least one metal sulfonate selected from the group consisting of overbased calcium sulfonate, overbased magnesium sulfonate and mixtures thereof in an amount sufficient to provide a base number from about 8.0 to about 12.0 in said lubricating oil.

2. The lubricating oil of claim 1 wherein said total base number is from about 10.0 to about 13.0.

3. The lubricating oil of claim 1 wherein said overbased sodium sulfonate is present in an amount sufficient to provide a base number from about 1.4 to about 1.8 in said lubricating oil.

4. The lubricating oil of claim 1 wherein said overbased metal sulfonate is present in an amount sufficient to provide a base number from about 9.0 to about 11.0 in said lubricating oil.

5. The lubricating oil of claim 1 wherein from about 7 to about 22 percent of the total base number is said lubricating oil is provided by said overbased sodium sulfonate.

6. The lubricating oil of claim 1 wherein said overbased metal sulfonate comprises overbased calcium sulfonate.

7. A lubricating oil for use in methanol fueled internal combustion engines, said lubricating oil having a total base number from about 9.0 to about 14.0 and: consisting essentially of:

a) a suitable base oil;

b) overbased sodium sulfonate in an amount sufficient to provide a base number from about 1.0 to about 2.0 in said lubricating oil; and c) overbased magnesium sulfonate in an amount sufficient to provide a base number from about 8.0 to about 12.0 in said lubricating oil.

8. The lubricating oil of claim 7 wherein said total base number is from about 10.0 to about 13.0.

9. The lubricating oil of claim 7 wherein said overbased sodium sulfonate is present in an amount sufficient to provide a base number from about 1.4 to about 1.8 in said lubricating oil.

10. The lubricating oil of claim 7 wherein said overbased metal sulfonate is present in an amount sufficient to provide a base number from about 9.0 to about 11.0 in said lubricating oil.

11. The lubricating oil of claim 7 wherein from about 7 to about 22 percent of the total base number in said lubricating oil is provided by said overbased sodium sulfonate.

12. A lubricating oil for use in methanol fueled internal combustion engines, said lubricating oil having a total base number from about 9.0 to about 14.0 and consisting essentially of:

a) a suitable base oil b) overbased sodium sulfonate in an amount sufficient to provide a base number from about 1.0 to about 2.0 in said lubricating oil; and c) overbased calcium sulfonate in an amount sufficient to provide a base number from about 8.0 to about 12. 0 in said lubricating oil.

13. The lubricating oil of claim 12 wherein said total base number is from about 10 to about 13.

14. The lubricating oil of claim 12 wherein said overbased sodium sulfonate is present in an amount sufficient to provide a base number from about 1.4 to about 1.8 in said lubricating oil.

15. The lubricating oil of claim 12 wherein said overbased calcium sulfonate is present in an amount sufficient to provide a base number from about 9.0 to about 11.0 in said lubricating oil.

16. A lubricating oil having a total base number from about 9.0 to about 14.0 and containing:

a) a suitable base oil;

b) overbased sodium sulfonate in an amount sufficient to provide a base number from about 1.0 to about 2.0 in said lubricating oil; and c) at least one metal sulfonate selected from the group consisting of overbased calcium sulfonate, overbased magnesium sulfonate and mixtures thereof in an amount sufficient to provide a base number from about 8.0 to about 12.0 in said lubricating oil.

17. The lubricating oil of claim 16 wherein said lubricating oil contains at least one additive selected from the group consisting of detergent additives, corrosion inhibitor additives, viscosity improver additives and phosphate additives.

18. The lubricating oil of claim 16 wherein said lubricating oil has an ash level less than about 1.4 weight percent.

19. A lubricating oil having a total base number from about 9.0 to about 14.0 and containing:

a) a suitable base oil;

b) overbased sodium sulfonate in am amount sufficient to provide a base number from about 1.0 to about 2.0 in said lubricating oil; and c) overbased magnesium sulfonate in an amount sufficient to provide a base number from about 8.0 to about 12.0 in said lubricating oil.

20. The lubricating oil of claim 19 wherein said lubricating oil contains at least one additive selected from the group consisting of detergent additives, corrosion inhibitor additives, viscosity improver additives and phosphate additives.

* * * * *